United States Patent [19]

Haywood

[11] Patent Number: 4,892,352

[45] Date of Patent: Jan. 9, 1990

[54] SEAT

[76] Inventor: Michael Haywood, Hillside, Bushcombe Lane, Woodmancote, Cheltenham GL 52 4QL, England

[21] Appl. No.: 265,542

[22] Filed: Nov. 1, 1988

[30] Foreign Application Priority Data

Nov. 4, 1987 [GB] United Kingdom ..... 8725782

[51] Int. Cl.[4] ..... A47B 39/00

[52] U.S. Cl. ..... 297/195; 108/43; 297/174; 297/239

[58] Field of Search ..... 297/195, 135, 4, 427, 297/170, 174, 239; 272/114, 70.3; 108/43; 248/444, 420, 538, 155, 155.3

[56] References Cited

U.S. PATENT DOCUMENTS

| | | | |
|---|---|---|---|
| 3,266,839 | 8/1966 | Combs | 248/155 X |
| 3,432,162 | 3/1969 | Flemming | 272/70.3 |
| 4,650,249 | 3/1987 | Serber | 297/195 X |
| 4,653,808 | 3/1987 | Opsvik | 297/195 X |
| 4,767,159 | 8/1988 | Opsvik | 297/195 X |

FOREIGN PATENT DOCUMENTS

| | | | |
|---|---|---|---|
| 2334400 | 1/1975 | Fed. Rep. of Germany | 297/195 |

*Primary Examiner*—James T. McCall
*Attorney, Agent, or Firm*—Young & Thompson

[57] ABSTRACT

A seat comprises a seating member, a ground engageable support depending from the seating member, the support along being incapable of maintaining the seating member in a stable seating position, and a stabilizer. The stabilizer projects forwards of the seating member and includes, at a position removed from the seating member, a leg abutment for making contact with the front of a seated user's leg at or above the knee joint. The stabilizer may be adapted to extend between the seated user's legs and the leg abutment may be adapted to make contact with the front of both legs of a seated user. The seat may be formed as an integral plastics moulding, or it could be foldable or formed of at least two separable parts for ease of transportation.

7 Claims, 1 Drawing Sheet

SEAT

INTRODUCTION

This invention relates to a seat and particularly but not exclusively to a seat which is easily transportable.

Conventionally seats ar in the form of chairs or stools having three or more legs for supporting a seating member in a stable seating position. Shooting sticks having a single elongate ground engageable support and a pair of outwardly foldable seating members at the upper end of the elongate support are also known, but these are neither particularly comfortable nor particularly stable.

SUMMARY OF THE INVENTION

According to the present invention, there is provided a seat comprising a seating member, ground engageable support means depending from the seating member, the support means alone being incapable of maintaining the seating member in a stable seating position, and stabiliser means projecting forwards of the seating member and including, at a position removed from the seating member, leg abutment means for making contact with the front of a seated user's leg.

Preferably, the stabiliser means is adapted to extend between a seated user's legs.

Advantageously, the leg abutment means is adapted to make contact with the front of both legs of a seated user at or above the knee joints.

The seat may be foldable or may be formed of two separable parts for ease of transportation.

The invention will now be more particularly described, by way of example only, with reference to the accompanying drawings.

DESCRIPTION OF THE PREFERRED EMBODIMENTS

Figure 1:
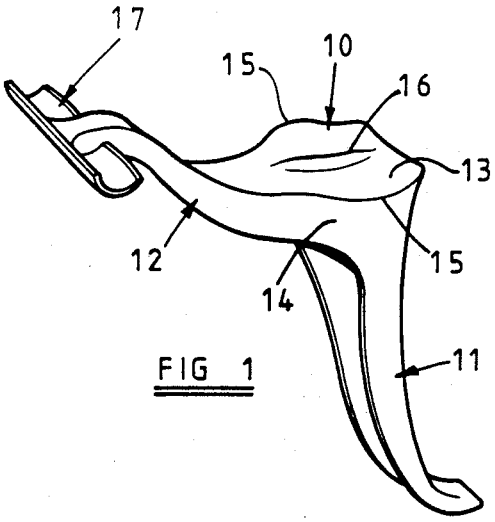
FIG. 1 is a perspective view of one embodiment of a seat according to the invention, FIG. 2 a side view of a modified version of the seat of FIG. 1, shown in use.

Referring firstly to FIG. 1 the seat shown therein is in the form of an integral plastics moulding and comprises a seating member 10, a ground engageable support in the form of a single leg 11 depending from the seating member 10, and a stabiliser in the form of a beam 12 projecting forwardly from the seating member 10.

The seating member 10 has a recessed upper surface 13, and a peripheral skirt 14 which merges with the leg 11 and the beam 12. The seating member 10 has an outwardly extending bulge 15 on each of its two opposite sides and narrows from each bulge 15 towards the beam 12. The recessed upper surface 13 of the seating member 10 has a central raised hump 16 aligned with the longitudinal extent of the beam 12.

The leg 11 is curved rearwardly at its lower end and the beam 12 is of lazy S-shape and terminates at its forward end in a cross-member 17, although the beam 12 could extend forwards of the cross-member 17.

The cross-member 17, which forms a leg abutment, extends to each side of the beam 12 by an equal distance and is of arcuate cross-section so as to present a convex surface to the legs of a user.

Figure 2:
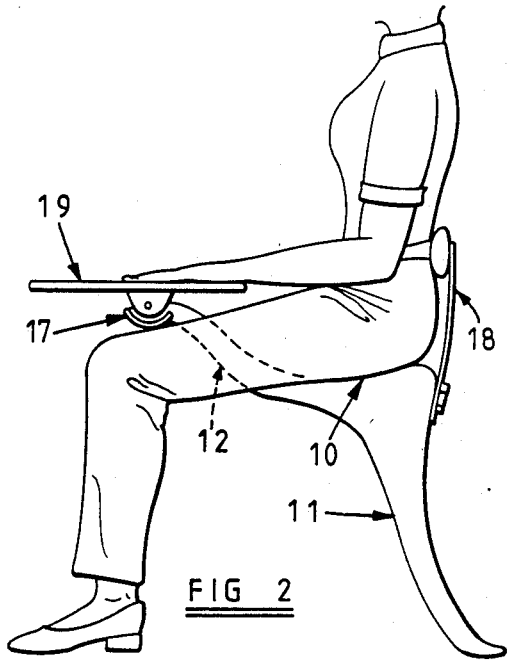

The seat shown in FIG. 1 is designed to be stackable with like seats and the modified version of the seat shown in FIG. 2 includes a back rest 18 secured to and upstanding from the rear of the seating member 10 and a table 19 which is pivotably attached to the forward end of the beam 12. Instead of the table 19, one or more tools could be attached to the forward end of the beam 12 or to the cross-member 17.

It will be readily appreciated that the single leg 11 is alone incapable of maintaining the seating member 10 in a stable seating position. FIG. 2 shows the seat in an operative position with a user seated on the seating member 10 and the beam 12 extending between the user's legs, and the cross-member 17 making contact with the front of the user's legs at or above the knee joints. To arrive at this position the user may start by holding the forward end of the beam 12 in one hand with the leg 11 to the rear in contact with the ground. The user would then pass one leg around the rear of the leg 11 and move into a seated position coming into contact with the seating member and at the same time lowering the cross-member 17 onto the legs at or just above the knees. The user's feet may then be positioned slightly apart and in a position affording most comfort. Once seated, the user has both hands free to use the table 19 for supporting a notebook, keyboard or other item. When in this position most of the user's weight is supported by the leg 11 but the remaining weight is transferred to the user's legs to provide stability. To leave the seat the user is able to take hold of the forward end of the beam 12 and stand up.

The rear of the seating member 10 could have recess of appropriate shape to define a carrying handle.

Figure 3:
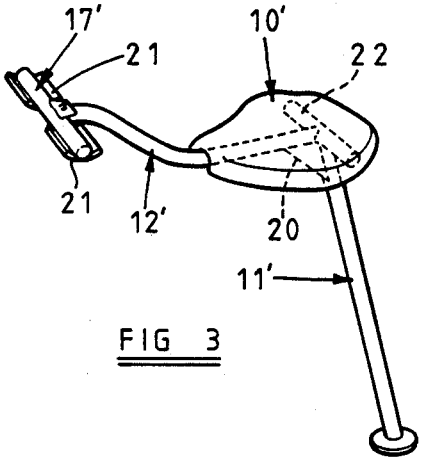
FIGS. 3 and 4 are perspective views of two further embodiments of a seat according to the invention.

In the embodiment shown in FIG. 3, the leg is in the form of a metal strut 11' which is secured at its upper end, such as by welding, to a metal beam 12' and braced to the beam 12' by a web 20. The cross-member is in the form of a metal rod 17' secured to the forward end of the beam 12' and provided with leg abutment pads 21 of arcuate cross-section. The seating member 10' is of plastics material and is attached to the beam 12' and to a cross-bar 22 provided at the join between the leg 11' the beam 12'.

Springs (not shown) could be provided between the seating member 10' on one hand and the beam 12' and cross-bar 22 on the other hand, and the strut 11' and/or the beam 12' could be telescopically adjustable or collapsible.

Figure 4:
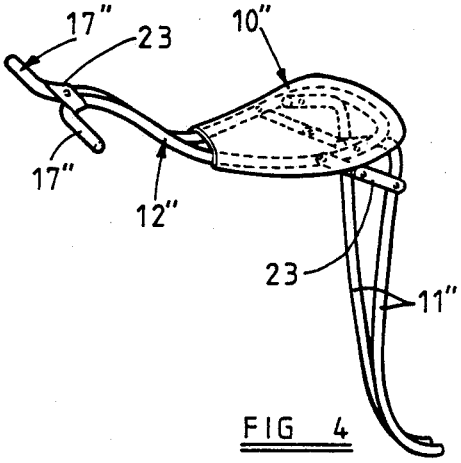

The embodiment shown in FIG. 4 is foldable for ease of transportation. The beam 12" is of generally U-shape with the two arms of the beam 12" drawn together at their forward ends by a bracket 23 and then angled outwards to form a leg abutment members 17". The seating member 10" is attached to the rearward end of the U-shaped beam 12" and the leg comprises two leg members 11" which are pivotably connected at their upper ends to the rearward ends of respective arms of the U-shaped beam 12" and which are drawn together and curved rearwardly at their lowermost ends. Linkages 23 are provided to releasably retain the leg members 11" in an operative position relative to the beam 12" and may be simple two part linkages or over centre toggle linkages. When not in use the seat shown in FIG. 4 may be folded to bring the beam 12" and leg members 11' together for ease of transportation and if desired this seat could be designed for use as a walking stick when in a folded condition. Moreover, the linkages 23 could be adjustable to vary the angle between the leg and the beam when in use.

Instead of providing a foldable construction the seat could be formed in two or more separable parts for ease of transportation.

If desired the seat could be transformed into a plaything by adding one or more wheels, skates, skis or floats to the lower end of the leg of the seat and in this case wheels, skates, skis or floats could be attached to a user's feet. Also the seat could, in this case, be fitted with some means of propulsion.

The seats described above all have a stabiliser which includes a beam which is adapted to extend between a user's legs. However, the stabiliser could be in the form of one or more beams which extend to one or both sides of a user's legs and which is/are provided with leg abutment means at positions removed from the seating member for making contact with one or both of the user's legs.

Other modifications will be apparent to a person skilled in the art without departing from the scope of the invention as defined in the appended claims.

What I claim is:

1. A seat comprising a seating member, ground engageable support means depending from the seating member, the support means alone being incapable of maintaining the seating member in a stable seating position, and stabilizing means projecting forwards of the seating member and including, at a position removed from the seating member, thigh abutment means for making contact with the front of a seated user's thigh, the seat being stackable with like seats for ease of storage.

2. A seat as claimed in claim 1, wherein the stabiliser means is adapted to extend between a seated user's legs.

3. A seat as claimed in claim 1, wherein the leg abutment means is adapted to make contact with the front of both thighs of a seated user.

4. A seat as claimed in claim 1, wherein the seat is foldable for ease of transportation.

5. A seat as claimed in claim 1, wherein the seat is formed of at least two separable parts for ease of transportation.

6. A seat as claimed in claim 1, wherein the stabilising means comprises a single forwardly projecting beam with the thigh abutment means adjacent to the forward end of the beam and wherein the ground engageable support means comprises a single depending leg.

7. A seat as claimed in claim 1, wherein the thigh abutment means comprises an arcuate pad arranged to present a convex surface to the front of a user's thigh.

* * * * *